US009037064B2

(12) United States Patent
Kondoh et al.

(10) Patent No.: US 9,037,064 B2
(45) Date of Patent: May 19, 2015

(54) FIXING MEMBER, FIXING DEVICE, AND IMAGE FORMING APPARATUS

(75) Inventors: Tsuneaki Kondoh, Kanagawa (JP); Tomoaki Sugawara, Kanagawa (JP); Junichiro Natori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/984,388

(22) PCT Filed: Feb. 24, 2012

(86) PCT No.: PCT/JP2012/055290

§ 371 (c)(1),
(2), (4) Date: Aug. 8, 2013

(87) PCT Pub. No.: WO2012/118166

PCT Pub. Date: Sep. 7, 2012

(65) Prior Publication Data

US 2013/0322942 A1 Dec. 5, 2013

(30) Foreign Application Priority Data

Mar. 2, 2011 (JP) ..... 2011-044663

(51) Int. Cl.
*G03G 15/20* (2006.01)

(52) U.S. Cl.
CPC .... *G03G 15/2057* (2013.01); *G03G 2215/2051* (2013.01)

(58) Field of Classification Search
CPC ..... G03G 15/2053; G03G 15/2057; G03G 2215/2048; G03G 2215/2051; G03G 2215/2054
USPC ..... 399/333
See application file for complete search history.

(56) References Cited

U.S. PATENT DOCUMENTS

| | | | | |
|---|---|---|---|---|
| 4,301,355 | A | 11/1981 | Kimbrough et al. | |
| 4,971,844 | A | 11/1990 | Schoustra et al. | |
| 5,327,202 | A * | 7/1994 | Nami et al. | 399/333 |
| 5,608,508 | A * | 3/1997 | Kumagai et al. | 399/339 |
| 5,679,463 | A | 10/1997 | Visser et al. | |
| 5,711,072 | A * | 1/1998 | Nakamura | 29/895.32 |
| 5,770,298 | A * | 6/1998 | Nakamura et al. | 428/195.1 |
| 5,895,711 | A | 4/1999 | Yamaki et al. | |
| 6,491,613 | B2 * | 12/2002 | Takeda et al. | 492/59 |

(Continued)

FOREIGN PATENT DOCUMENTS

| | | |
|---|---|---|
| EP | 0322099 A1 | 6/1989 |
| EP | 0843236 A2 | 5/1998 |

(Continued)

OTHER PUBLICATIONS

International Search Report Issued for counterpart International Patent Application No. PCT/JP2012/055290 dated Apr. 3, 2012.

(Continued)

*Primary Examiner* — David Gray
*Assistant Examiner* — Carla Therrien
(74) *Attorney, Agent, or Firm* — Cooper & Dunham LLP

(57) ABSTRACT

To provide a fixing member, which contains a base, and a polyorganosiloxane layer provided on the base, where the polyoranosiloxane layer contains polyoranosiloxane including a silicon atom bonded to three or four oxygen atoms, and wherein the fixing member is designed to be used in a process for heating a toner image on a recording medium to fix the toner image onto the recording medium.

13 Claims, 6 Drawing Sheets

(56) References Cited

U.S. PATENT DOCUMENTS

| | | | | |
|---|---|---|---|---|
| 6,838,140 | B1 * | 1/2005 | Heeks et al. | 428/36.8 |
| 7,558,520 | B2 | 7/2009 | Sugawara et al. | |
| 7,700,171 | B2 * | 4/2010 | Matsunaka et al. | 428/34.1 |
| 7,725,068 | B2 * | 5/2010 | Matsunaka et al. | 399/333 |
| 7,991,338 | B2 * | 8/2011 | Funabiki | 399/329 |
| 2004/0069404 | A1 | 4/2004 | Kondoh | |
| 2004/0224165 | A1 | 11/2004 | Kondoh et al. | |
| 2005/0064690 | A1 | 3/2005 | Amos et al. | |
| 2005/0095381 | A1 | 5/2005 | Kondoh | |
| 2005/0207806 | A1 | 9/2005 | Yoshii et al. | |
| 2006/0198666 | A1 | 9/2006 | Kondoh et al. | |
| 2007/0140758 | A1 | 6/2007 | Aze et al. | |
| 2008/0063444 | A1 | 3/2008 | Kondoh et al. | |
| 2008/0187852 | A1 | 8/2008 | Kitano et al. | |
| 2009/0003903 | A1 | 1/2009 | Katano et al. | |
| 2009/0263584 | A1 | 10/2009 | Katano et al. | |
| 2010/0119269 | A1 | 5/2010 | Kondoh et al. | |
| 2010/0129123 | A1 | 5/2010 | Natori et al. | |
| 2011/0013957 | A1 | 1/2011 | Katano et al. | |

FOREIGN PATENT DOCUMENTS

| | | |
|---|---|---|
| JP | 57-052574 | 3/1982 |
| JP | 02-059781 | 2/1990 |
| JP | 05-066589 | 9/1993 |
| JP | 07-311508 | 11/1995 |
| JP | 10-142987 | 5/1998 |
| JP | 2000-112271 | 4/2000 |
| JP | 2000-267487 | 9/2000 |
| JP | 3243991 | 10/2001 |
| JP | 2002-082558 | 3/2002 |
| JP | 2004-126178 | 4/2004 |
| JP | 2004-252000 | 9/2004 |
| JP | 3603428 | 10/2004 |
| JP | 2005-062413 | 3/2005 |
| JP | 2005-084294 | 3/2005 |
| JP | 2006-133624 | 5/2006 |
| JP | 2006-176293 | 7/2008 |
| JP | 4151359 | 7/2008 |
| JP | 2008-255283 | 10/2008 |
| JP | 2009-31630 | 2/2009 |
| JP | 2010-140003 | 6/2010 |

OTHER PUBLICATIONS

European search report dated Jul. 16, 2014 in corresponding European patent application No. 12 75 2150.8.

Korean official action dated Sep. 11, 2014 and English translation in corresponding Korean patent application No. 10-2013-7025569.

* cited by examiner

FIXING MEMBER, FIXING DEVICE, AND IMAGE FORMING APPARATUS

TECHNICAL FIELD

The present invention relates to a fixing device to be mounted in an electrophotographic image forming apparatus, such as a photocopier, printer, and facsimile, and also relates to a fixing member having high release properties, which is mounted in the fixing device.

BACKGROUND ART

Conventionally, a device applied for an electrophotographic system, e.g. an image forming member such as a photocopier, printer, and facsimile, generally contains a rotatable photoconductor drum, and forms a latent electrostatic image on the photoconductor drum by uniformly charging a photosensitive layer of the photoconductor drum, followed by exposing the charged photosensitive layer of the photoconductor drum with laser beams emitted from a laser scanning unit. The image forming apparatus further contains a system for operating the following process. Namely, after developing the formed latent electrostatic image with a toner, the developed image is transferred to a transfer paper as a recording material, and is then thermally fixed on the transfer paper by passing the transfer paper through a thermal fixing device.

The fixing member having sufficient elasticity for attaining the fixing ability suitable for color images, however, has a problem that it has poor abrasion resistance, and release properties for a toner.

The fixing system generally applies a fixing system for fixing a toner image on a recording sheet by passing the recording sheet between a fixing roller or fixing belt and a pressure roller in contact with the fixing roller or belt with a certain pressure, and softening and pressurizing the deposited toner on the recording sheet with sheet.

Since the fused toner image is brought into contact with a fixing member in this fixing system, a surface layer of the fixing member is formed in the film thickness of 15 μm to 30 μm with a material having high release properties (e.g. a fluororesin). This material, however, has a disadvantage that the material has a high degree of hardness due to the characteristics of the resin. If the material has the high degree of the hardness, the material cannot correspond to the irregularities of the paper fibers when the toner image electrostatically formed is fixed by heat and pressure, and therefore high quality images cannot be formed. Especially, because of the polularities of full-color image formation, the fixing is currently performed on a plurality of color toners in the manner that the fixing member is brought into contact with the color toners to cover the shapes of the toners to thereby melt the color toner. Therefore, the hardness of the material greatly affects the fixation and resulting images.

To solve this problem, a method for forming an elastic material (e.g., silicone rubber and fluororubber) on a surface of a fixing member has been applied.

By using the elastic material to the fixing member, the correspondence to the irregularities of the paper fibers can be improved. This fixing member however cannot secure the degree of the durability to the same level as that of the fluororesin. Therefore, the fixing member using the elastic material tends to be scratched by the frictions with transfer paper or by the scratches formed on the transfer paper by a separation claw for separating the transfer paper. These scratches are transferred during the fixing process to thereby form abnormal images. Moreover, as a conventional technique, it is known that a large amount of silica powder or alumina powder is formulated into a silicone rubber composition of an elastic material for the purpose of improving abrasion resistance. This silicone rubber however has high rubber hardness, which as described earlier, cannot attain sufficient elasticity to provide high quality images. Therefore, there is proposed an invention which related to a material for improving the hardness of the elastic material by reducing crosslink density to provide low hardness of the rubber, for example as in PTL 1. In this case, however, inorganic fillers may fall out as the rubber strength reduces, and therefore sufficient abrasion resistance cannot be attained. Depending on the conditions, the inorganic filler functions as an abrasion agent, which may accelerate abrasion in some cases.

Further, a fixing member using an elastic material cannot secure its release properties to the extend that that of the fluororesin does, and therefore offset needs to be prevented by coating or dipping the fixing member with or in a compatible low molecular oil component to supplement the release properties. In this method, however, there are various problems such as staining transfer paper by smearing of the oil component during the standing period, a problem in maintenance, and problem in continuity of the release ability, and furthermore there is a problem that a device is required for supplying a liquid for preventing offset, which makes a configuration of a fixing device complex. Accordingly, based on the insight that a liquid for preventing offset is supplied from inside toner particles during heating without using silicone oil, there is proposed a method for adding a releasing agent to a toner (see, for example, PTL 2 to PTL 4). When a large amount of the additive is added to obtain a sufficient release effect, filming on a photoconductor, or surface deposition on a toner bearing member (e.g. a carrier or sleeve) occurs, which degrades resulting images and such resulting images have problem on practical use. Therefore, it is important to add a releasing agent to a toner in a small amount but sufficient enough to prevent deterioration of images. From this point of view, there is a demand for a fixing member having higher release properties.

PTL 5 discloses a fixing member which uses an so organic inorganic hybrid material obtained by heating a sol containing a metal alkoxide and a solid silica compound to form a gel, as an elasticity material, to thereby improve heat resistance and release properties, but it has not yet been brought into practice.

CITATION LIST

Patent Literature

PTL 1: Japanese Patent (JP-B) No. 3243991
PTL 2: Japanese Patent Application Publication (JP-B) No. 52-3304
PTL 3: Japanese Patent Application Publication (JP-B) No. 52-3305
PTL 4: Japanese Patent Application Laid-Open (JP-A) No. 57-52574
PTL 5: JP-A No. 2002-82558

SUMMARY OF INVENTION

Technical Problem

The present invention solves various problems in the art, and achieves the following object. Specifically, the object of the present invention is to provide a fixing member having an outermost surface whose durability and release properties have been improved, with sufficient elasticity for giving high image quality to correspond to full color printing, to thereby provide a fixing device and electrophotographic image forming apparatus realizing both high image quality and high reliability, as well as stable fixing over a long period.

Solution to Problem

The present invention includes the following embodiments of a fixing member, a fixing device, and an image forming apparatus.

<1> A fixing member, containing:

a base; and a polyorganosiloxane layer provided on the base, where the polyorganosiloxane layer contains polyorganosiloxane including a silicon atom bonded to three or four oxygen atoms, wherein the fixing member is designed to be used in a process for heating a toner image on a recording medium to fix the toner image onto the recording medium.

<2> The fixing member according to <1>, wherein the polyorganosiloxane layer has the maximum value of an oxygen atom concentration in an area of the polyorganosiloxane layer, which is 5 nm to 50 μm in depth from an outermost surface of the polyorganosiloxane layer.

<3> The fixing member according to any of <1> or <2>, wherein the polyorganosiloxane layer has the minimum value of a carbon atom concentration in an area of the polyorganosiloxane layer, which is 5 nm to 50 μm in depth from an outermost surface of the polyorganosiloxane layer.

<4> The fixing member according to any one of <1> to <3>, wherein a depth of the polyorganosiloxane layer where the oxygen atom concentration has the maximum value and a depth of the polyorganosiloxane layer where the carbon atom concentration has the minimum value are identical.

<5> The fixing member according to any one of <1> to <4>, wherein the polyorganosiloxane layer has a surface to which a perfluoroalkyl ether group is bonded via an oxygen atom.

<6> The fixing member according to any one of <1> to <5>, further containing an elastic layer provided between the base and the polyorganosiloxane layer.

<7> The fixing member according to <6>, wherein the elastic layer contains elastic rubber having siloxane bonds in a principle chain thereof.

<8> The fixing member according to <7>, wherein the elastic rubber is fluorosilicone rubber.

<9> The fixing member according to any one of <1> to <8>, wherein the fixing member has a universal hardness of 0.5 $N/mm^2$ or lower with an indentation depth of 5 μm.

<10> A fixing device, containing:

the fixing member as defined in any one of <1> to <9>.

<11> The fixing device according to <10>, wherein the fixing device contains a fixing roller and a pressure roller provided to face the fixing roller, where at least either of the fixing roller or the pressure roller is the fixing member.

<12> The fixing device according to <10>, wherein the fixing device contains a fixing belt and a pressure belt provided to face the fixing belt, where at least either of the fixing belt or the pressure belt is the fixing member.

<13> An image forming apparatus, containing:

the fixing device as defined in any one of <10> to <12>.

Advantageous Effects of Invention

The effect of the embodiments <1> to <4> of the invention includes providing a fixing member realizing "high durability by improving the abrasion resistance of the fixing member".

The effect of the embodiments <5> to <9> of the invention includes, in addition to the effect of the embodiments <1> to <4> of the invention, improving release properties of the outermost surface of the fixing member to reduce adhesion force of a melted toner, or reduce occurrences of jamming of paper due to adhering or wrapping around of paper, and realizing stable fixing over a long period.

The effect of the embodiments <10> to <12> of the invention includes, in addition to the effects of the embodiments <1> to <9> of the invention, providing a fixing device whose durability and reliability have been improved by using these embodiments of the fixing member.

The effect of the embodiment <13> of the invention includes, in addition to the effect of the embodiments <10> to <12> of the invention, being capable of using electrophotographic photocopiers, facsimiles, and laser printers having high durability and high reliability by using these embodiments of the fixing device, and contributing to "reduction in environmental loads" or "customer satisfaction."

DESCRIPTION OF EMBODIMENTS

The present invention is specifically explained hereinafter.

First, the general outline of an image forming apparatus in which the fixing member of the present invention is used is explained.

Figure 1:
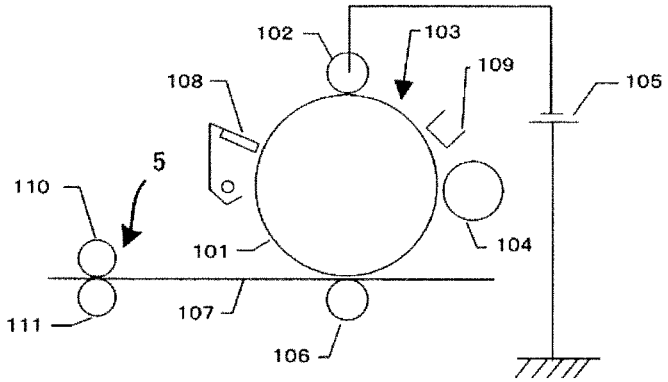
FIG. 1 is a schematic diagram illustrating one example of the image forming apparatus of the present invention.

FIG. 1 schematically illustrates the structures of a photoconductor, image forming section, and fixing device 5 of the image forming apparatus. The image forming process performed by this electrophotographic image forming apparatus contains; after uniformly charging a photosensitive layer of a rotating photoconductor drum 101 by a charging roller 102, exposing the charged photosensitive layer to laser beams 103 emitted from a laser scanning unit, which is not illustrated in the diagram to form a latent electrostatic image on the photoconductor drum 101; developing the latent electrostatic image with a toner to form a toner image; transferring the toner image onto a recording sheet 107; passing the recording sheet 107 through the fixing device 5 to heat and press the toner image to thereby fix the image onto the recording sheet 107.

Note that, in FIG. 1, 104 denotes a developing roller, 105 denotes a power pack (power source), 106 denotes a transfer roller, 108 denotes a cleaning device, and 109 denotes a surface electrometer. The fixing device 5 employs a heat fixing roller 110 which contains a base and an elastic layer provided on the base. The heat fixing roller 110 has a heater such as a halogen lamp, provided in a void space within a core rod along with the rotation center line, and the heat fixing roller 110 is heated from inside with radiant heat.

Moreover, a pressure roller 111 is provided parallel to the heat fixing roller 110 in the manner that the pressure roller 111 is in contact with the heat fixing roller 110 with a certain pressure. As the recording sheet passes through between the pressure roller 111 and the heat fixing roller 110, the toner deposited on the recording sheet is softened by the heat of the heat fixing roller 110, and at the time, the toner is pressed by nipping the recording sheet with the pressure roller 111 and the heat fixing roller 110, to thereby fixing the toner image onto the recording sheet. The fixing device 5 contains a fixing roller and a pressure roller provided to face the fixing roller, where at least either of the fixing roller or the pressure roller is the below-mentioned fixing member.

In accordance with the present invention, the fixing device may be a belt fixing device.

Figure 2:
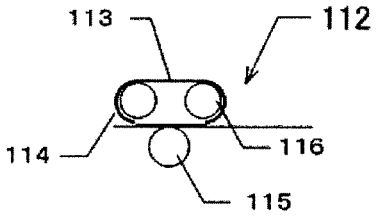
FIG. 2 is a schematic diagram illustrating one example of a belt fixing device of the present invention.

FIG. 2 illustrates a belt fixing device 112. In FIG. 2, 113 denotes a fixing belt, 114 denotes a fixing roller, 115 denotes a pressure roller, and 116 denotes a heat roller. In full-color photocopiers or laser printers, four color toners, magenta, cyan, yellow, black, are used. These color toners need to be mixed in the melted state during the fixing of the color image, and need to be uniformly mixed while covered with a surface of the fixing belt 113 in the melted state, as well as designing the toners to have low melting points so that they can be easily melted. The fixing device contains a fixing belt and a pressure belt provided to face the fixing belt, where at least either of the fixing belt or the pressure belt is the below-mentioned fixing member. (The fixing roller and the fixing belt may be referred to collectively as a "fixing member" hereinafter.)

A fixing belt member for use in the present invention will be specifically explained hereinafter.

As illustrated in FIG. 2, a fixing belt as a heating member is suspended around and supported by a fixing roller 114 and a heat roller 116.

Figure 3:
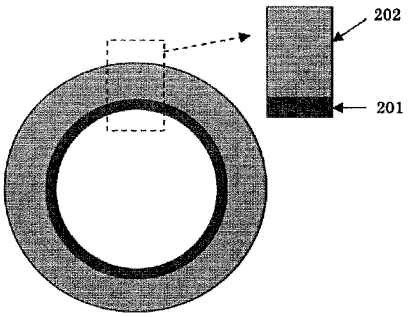
FIG. 3 is a schematic diagram illustrating one example of the structure of the fixing member of the present invention.

Moreover, FIG. 3 is a schematic diagram illustrating a structure of a fixing member, and the fixing member is constructed from a base 201 and an elastic layer 202.

The base 201 is appropriately selected depending on the intended purpose without any restriction, provided that it is formed of a heat resistant material. For example, as the base, a resin material such as polyimide, polyamideimide, polyether ether ketone (PEEK), polyether sulfone (PES), polyphenylene sulfide (PPS), and a fluororesin, can be used. Moreover, a material in which magnetic electrical conductive particles are dispersed may also be used. In this case, the magnetic electrical conductive particles are added in an amount of 20% by mass to 90% by mass relative to the resin material. Specifically, the magnetic electrical conductive particles are dispersed in the resin material in the state of a varnish by means of a disperser such as a roll mill, sand mill, and a centrifugal defoaming device. The viscosity of the resultant is appropriately adjusted with a solvent, and is molded by a mold to have a predetermined layer thickness. Moreover, the base can be formed of a metal, such as alloys of nickel, iron, and chrome, which may generate heat itself. A thickness of the base is 30 μm to 500 μm in view of a thermal capacity thereof, and strength thereof.

In the case where the base is formed of the metal material, a thickness of the base is ideally 100 μm or thinner considering bending of the belt. In the case of the metal material, a predetermined Curie point can be attained by adjusting an amount of each material to be added and processing conditions. By forming a heating layer with the magnetic electrical conductive material having the Curie point at the adjacent to the fixing temperature of the fixing belt, the heating layer can be heated by electromagnetic induction without over heated. Furthermore, the base can also be formed of an elastic material. Examples thereof include natural rubber, styrene butadiene rubber (SBR), butyl rubber, chloroprene rubber, nitrile rubber, acrylic rubber, urethane rubber, silicone rubber, fluorosilicone rubber, fluororubber, and liquid fluoroelastomer. Among them, silicone rubber, fluorosilicone rubber, fluororubber, fluorocarbon siloxane rubber, and liquid fluoroelastomer are preferable particularly in view of heat resistance.

For the elastic layer formed on the base, a heat resistant elastic material, preferably a heat resistant rubber is used. Examples of the heat resistant elastic material include natural rubber, SBR, butyl rubber, chloroprene rubber, nitrite rubber, acrylic rubber, urethane rubber, silicone rubber, fluorosilicone rubber, fluororubber, and liquid fluoroelastomer. Among them, silicone rubber, fluorosilicone rubber, fluororubber, fluorocarbon siloxane rubber, liquid fluoroelastomer are preferable particularly in view of heat resistance, and silicone rubber, and fluorosilicone rubber are preferable particularly in view of heat resistance and wetting ability with a releasing agent contained in a toner.

In one of the embodiments of the present invention, a surface modification treatment is performed on the elastic material. The surface modification treatment is not particularly limited, and examples thereof include a plasma treatment, electron beam crosslinking, and UV ozone treatment. In the case of the plasma treatment, the plasma generating device for use includes those of a horizontal plate, capacitive coupling, and inductive coupling, as well as including a device for a corona discharge treatment and an atmospheric plasma generator. Among them, a vacuum plasma treatment is preferable in view of the durability. The reaction pressure for the plasma treatment is 0.05 Pa to 100 Pa, preferably 1 Pa to 20 Pa. The reaction gas used for the plasma treatment is not particularly limited, and for example, inert gas, rare gas, and gas such as oxygen are effectively used. Among then, argon is particularly preferable in view of its long lasting effect. The irradiated electric energy is defined by (output×irradiation duration), and is set in the range of 5 Wh to 200 Wh, preferably 10 Wh to 50 Wh.

In the conventional art, it is proposed to perform a plasma treatment or UV treatment to generate active groups by excitation and/or oxidation for the purpose of enhancing adhesion force between layers. This method is however limited to the application for between layers, and it is known that the application of this method to the outermost surface is not preferable as the release properties reduce. In addition, the reaction is carried out in the presence of oxygen to effectively introduce reactive groups (hydroxyl groups) in this method, the nature of which is different from the present invention. In the embodiment of the present invention, the plasma treatment is carried out in a reaction environment where oxygen is low and the pressure is reduced. Therefore, re-crosslinking and/or re-bonding at the surface are accelerated to improve the durability owing to "increase of Si—O bonds having high bonding energy," and to improve release properties owing to "the improved fine surface texture due to the increase crosslink density." Note that, active groups are partially generated in the embodiment of the present invention, but the active groups are deactivated by treating with a coupling agent, which will be described later, to thereby improve release properties.

The fixing member formed in the manner mentioned above is analyzed with XPS along with the depth direction thereof from the outermost layer to the inner portion thereof. XPS is a device capable of detecting an atom concentration of atoms of the measuring sample, or a bonding state thereof by capturing electrons jumped due to the photoelectron effect.

Figure 4A:
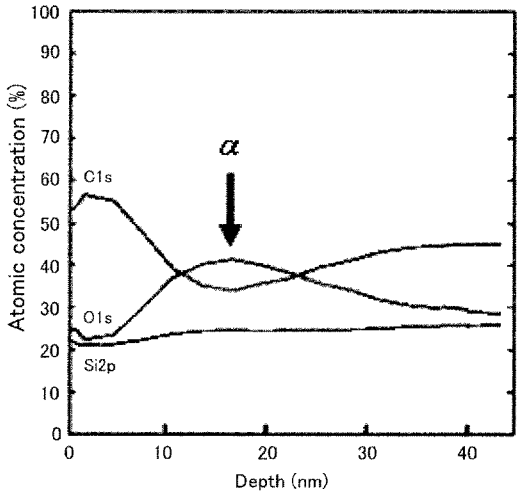
FIG. 4A is a diagram illustrating one example of the measurement result of the surface of the fixing member (surface-modified silicone rubber) of the present invention by C60 Depth Profile (atomic concentration ratio of each atom in the depth direction).

In the case of the silicone rubber that can be used as the elastic layer in the present invention, for example, a wide scan spectrum is measured with targeting the main components to Si, O, and C owing to the siloxane bond, and an atomic concentration ratio (atomic %) of each atom in the depth direction is measured based on a relative peak intensity ratio of each element present in an area from the surface layer to the inner portion. The results are depicted in FIG. 4A. The horizontal axis indicates the analysis depth from the surface towards the inner portion, and the longitudinal axis indicates the atomic ratio.

Figure 4B:
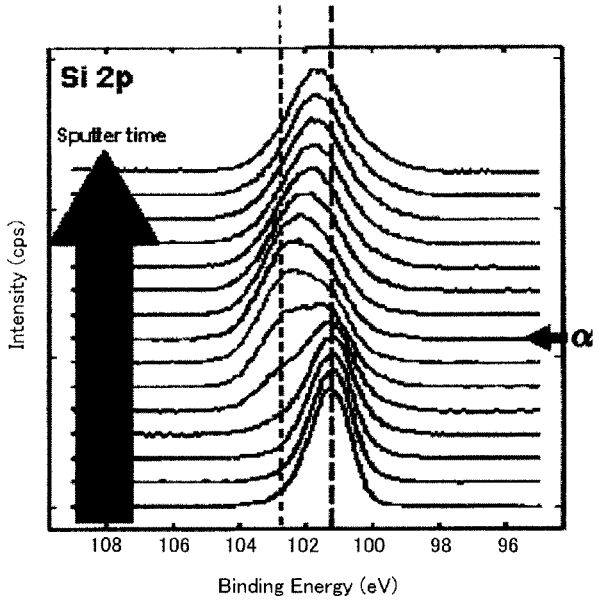
FIG. 4B is a diagram illustrating one example of the measurement result of the surface of the fixing member (surface-modified silicone rubber) of the present invention by C60 Depth Profile (an orbital spectrum of Si2P).

Further, in the case of the silicone rubber, atoms bonded to the silicon atom and the bonding state can be detected by measuring the energy at which electrons of 2p orbital of Si jump. The peak is separated from the narrow scan spectrum of the Si 2p orbital depicting the bonding state of Si as in FIG. 4B, the state of chemical bonds is analyzed. The horizontal axis indicates the bonding energy, and the longitudinal axis indicates the intensity ratio. Moreover, the arrow showing the direction from the bottom to the up indicates the measurement spectrums in the depth direction.

The measurement conditions are presented in Table 1. It is known that the peak shift generally depends on the bonding state. In the case of the silicone rubber related to the present embodiment, the fact that the peak of the Si 2p orbital is shifted to the side of the higher energy means that the number of oxygen atoms bonded to the Si atom is increased.

According to the measurements above, by performing the surface treatment, the oxygen concentration increases from the outermost layer to the inner portion to have the maximum value, and the carbon concentration decreases from the outermost layer to the inner portion to have the minimum value. As the analysis is carried out further in the depth direction the oxygen concentration decreases after reaching the maximum value, and the carbon concentration increases after reaching the minimum value. On the whole, the atom concentration of each atom in the entire portion is appropriately identical to that of untreated rubber. Further, the maximum value of the oxygen detected at of FIG. 4A matches the phenomenon that the Si 2p bonding energy shifts to the higher energy side ($\alpha$ of FIG. 4B), which indicates that the increase in the oxygen concentration is related to the number of oxygen atoms bonded to Si.

Figure 5A:
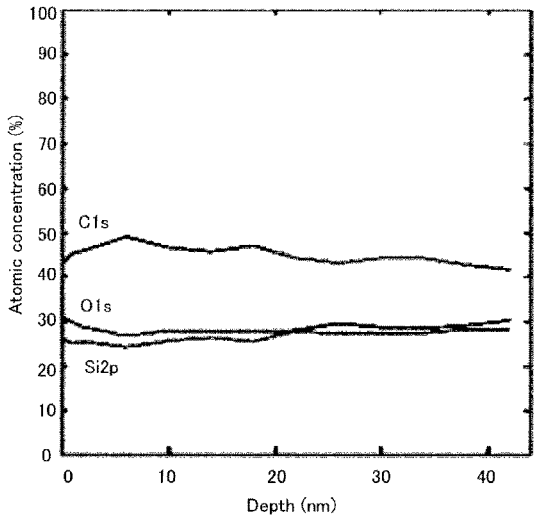
FIG. 5A is a diagram illustrating one example of the measurement result of the surface of the fixing member (untreated silicone rubber) by C60 Depth Profile (atom concentration ratio of each atom in the depth direction).
Figure 5B:
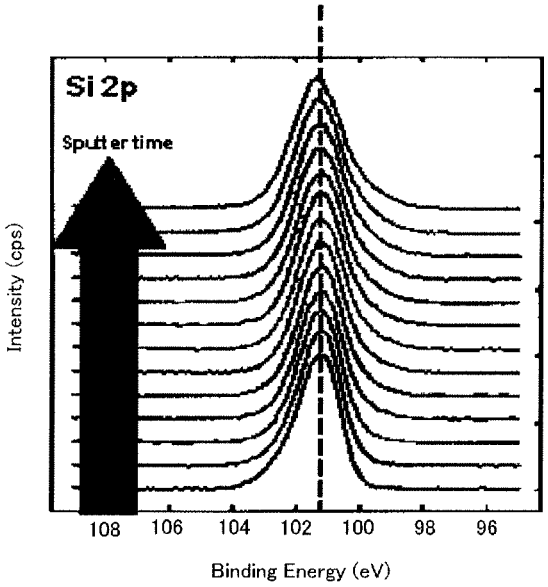
FIG. 5B is a diagram illustrating one example of the measurement result of the surface of the fixing member (untreated silicone rubber) by C60 Depth Profile (an orbital spectrum of Si2P).

The results of the same analysis performed on the untreated silicone rubber are depicted in FIGS. 5A and 5B.

In the spectrums of FIG. 5A, the maximum value of the oxygen and the minimum value of the carbon as seen in the spectrums of FIG. 4A are not present. As there is no shift of the Si 2p bonding energy to the higher energy side in 5B, it is confirmed that there is no change in number of the oxygen atoms bonded to the Si atom.

The fixing member of the present invention preferably has the maximum value of the oxygen atom concentration in an area which is 5 nm to 50 μm in depth from the outermost surface thereof as measured by XPS depth profiling presented in Table 1. Moreover, at the depth where the maximum value of the oxygen atom concentration can be attained, the coefficient A of the following formula 1 is preferably 0.5 or more.

$$A=(B+G)/D \qquad \text{Formula 1}$$

B: the abundance ratio of silicon atoms each bonded to three oxygen atoms (calculated from the peak intensity at the bonding energy 102.52 eV of the Si2P orbital)

C: the abundance ratio of silicon atoms each bonded to four oxygen atoms (calculated from the peak intensity at the bonding energy 103.54 eV of the Si2P orbital)

D: the abundance ratio of silicon atoms each bonded to two oxygen atoms (calculated from the peak intensity at the bonding energy 101.79 eV of the Si2P orbital)

As mentioned above, a polyorganosiloxane layer containing polyorganosiloxane having a silicon atom bonded to three or four oxygen atoms is formed on a surface of the elastic layer on the base.

A thickness of the polyorganosiloxane layer is appropriately selected depending on the intended purpose without any restriction, but it is preferably 0.01 μm to 5 μm, more preferably 0.01 μm to 1.0 μm. When the thickness thereof is greater than 5 μm, the hardness thereof increases so that the resulting fixing member may not correspond to the irregularities of the paper or toner. When the thickness thereof is thinner than 0.01 μm, a sufficient durability of the polyorganosiloxane layer may not be obtained.

Furthermore, the outermost surface of the elastic layer may be appropriately modified, and for example, the outermost surface may be modified with a coupling agent, various monomers, a photosensitive functional group, a hydrophobic group, or a hydrophilic group. For example, a fluorine-based polymer may be formed at the outermost surface of the elastic layer. For example, the outermost surface is formed of an amorphous resin containing at least one functional group selected from the group consisting of a hydroxyl group, a silanol group, a carboxyl group, and a group capable of hydrolysis, and the amorphous resin of the outermost surface and the heat resistant rubber of the elastic layer are bonded via oxygen atoms. The amorphous resin is appropriately selected depending on the intended purpose without any restriction, and examples thereof include a resin having a perfluoropolyether in a principle chain thereof. The group capable of hydrolysis is not particularly limited, and examples thereof include: an alkoxy group such as a methoxy group, and an ethoxy group: and an alkoxysilane group such as a methoxysilane group, and an ethoxysilane group. The coupling agent is appropriately selected depending on the intended purpose without any restriction, and examples thereof include a metal alkoxide, and a solution containing a metal alkoxide. The metal alkoxide include, for example, a silicone alkoxide-based monomer represented by the following general formula (1), partially hydrolyzed polycondensate thereof having a polymerization degree of about 2 to about 10, a mixture thereof, and/or a solution containing the foregoing monomer or compounds and an organic solvent.

$$R_{1(4-n)}Si(OR_2)_n \qquad \text{General Formula (1)}$$

In the general formula (1), $R_1$ and $R_2$ are each independently a C1-C10 linear or branched chain alkyl group, an alkyl polyether chain, or an aryl group or derivatives thereof, and n is an integer of 2 to 4.

Specific examples of the compound represented by the general formula (1) include dimethyl dimethoxysilane, diethyl diethoxysilane, diethyl dimethoxysilane, diethyl diethoxysilane, diphenyl dimethoxysilane, diphenyl diethoxysilane, methyl trimethoxysilane, methyl triethoxysilane, tetramethoxysilane, tetraethoxysilane, and tetrapropoxysilane.

Among them, ethoxysilane is particularly preferable in view of durability. Moreover, $R_1$ may be a fluoroalkyl group, or may be a fluoroalkyl acrylate or perfluoropolyether bonded via oxygen. Among these groups, a perfluoropolyether group is particularly preferable in view of flexibility and durability.

Further, other examples include: vinyl silane such as vinyltris(β-methoxyethoxy)silane, vinyltriethoxysilane, and vinyltrimethoxysilane; acryl silane such as γ-methacryloxypropyl trimethoxysilane; epoxy silane such as β-(3,4-ethoxycyclohexyl)-ethyl trimethoxysilane, γ-glycidoxypropyl trimethoxysilane, and γ-glycidoxypropylmethyl diethoxysilane; and amino silane such as N-β(aminoethyl)-γ-aminopropyl trimethoxysilane, N-β-(aminoethyl)-γ-aminopropylmethyl dimethoxysilane, γ-aminopropyl triethoxysilane, and N-phenyl-γ-aminopropyl trimethoxysilane.

Moreover, a monomer represented by the general formula (1) provided that the metal atom is changed from Si to Ti, Sn, Al, or Zr may be used independently or in combination.

The treatment with a surface treating agent such as the coupling agent can be performed by impregnating (e.g., coating and dipping) a surface of the elastic material with the surface treating agent after performing the surface modification treatment (e.g., a plasma treatment, electron beam crosslinking, and UV ozone treatment) on the elastic material. As a result of the treatment, a modified layer having the maximum value of the oxygen atom concentration can be formed.

By impregnating the surface of the elastic material with a surface treating agent such as the coupling agent by coating or dipping, the surface treating agent penetrates into the base so that the polyorganosiloxane is presented with the concentration distribution. This distribution gives a distribution of the oxygen atom concentration contained in the polyorganosiloxane to have the maximum value in the area which is 5 nm to 50 μm in depth from the outermost surface.

The fixing member of the present invention preferably has universal hardness HU of 0.5 $N/mm^2$ or lower with an indentation depth of 5 μm. The universal hardness HU can be obtained, for example, according to DIN50359, by gradually pressing an indenter against the fixing member using a micro hardness tester Win-HUD, and determining the universal hardness from the pressing load and contact area of the indenter at the time when the depth of the indentation reaches 5 μm.

By adapting the structure of the fixing member of the present invention, the fixing member has the outermost surface so having flexibility and movable in the vertical direction, and corresponding to bumps formed of a toner or irregularities on transfer paper, and can secure sufficient elasticity for attaining high quality images corresponding to full color image formation. Moreover, the aforementioned structure can realize the fixing member, in which durability of the outermost surface has been significantly improved, by giving sufficient strength owing to the hardness against the state (abrasion loads) where the stress is horizontally applied to the interface and the shear stress is applied onto the surface. As a result, a fixing device and electrophotographic image forming apparatus realizing both high image quality and high reliability, and stable fixing over a long period can be provided.

EXAMPLES

The present invention will be explained through examples thereinafter, but these examples shall not be construed as limiting the scope of the present invention.

Example 1

A primer layer for silicone was formed as a base on a cylindrical support (polyimide) having a length of 320 mm, and thickness of 50 μm, and was dried. Thereafter, fluorosilicone rubber (X36-420U, manufactured by Shin-Etsu Chemical Co., Ltd.) was formed in the thickness of 200 μm on the base, and heated at 150° C. for 10 minutes.

The formed fluorosilicone rubber was subjected to a plasma treatment under the following conditions.

Derive: PR-500, manufactured by Yamato Scientific Co., Ltd.

Output: 100 W

Duration for the treatment: 4 minutes

Reaction gas: argon (99.999%)

Reaction pressure: 10 Pa

On the fluorosilicone rubber, a 0.1% fluorosilicon compound (OPTOOL DSX, manufactured by Daikin Industries. Ltd.) solution, in which the fluorosilicon compound had been diluted with perfluorohexane, was applied by dip coating at the withdrawal speed of 10 mm/min, and then was left in the environment having the temperature of 60° C. and the relative humidity of 90% for 30 minutes or longer. Thereafter, the resultant was dried at 150° C. for 10 minutes to thereby prepare a fixing member.

The fixing member produced in the aforementioned manner was mounted as a fixing belt in a fixing device of imagio MPC3000, manufactured by Ricoh Company Limited, and using this device a paper feed test was carried out by printing a toner solid image on 30,000 sheets of paper. As for paper, multipaper super white (available from Askul Co., Ltd.) was used. The results of the abrasion resistance and release properties were evaluated based on the criteria presented in Table 3. The evaluation results thereof are presented in Table 4.

Note that, the fixing member was subjected to XPS depth profiling and to a measurement of universal hardness. The results are presented in Table 4.

The XPS depth profiling was carried out under the conditions presented in Table 1, and evaluated based on the criteria presented in Table 3. Moreover, the coefficient A of the following formula 1 was obtained from the result of XPS depth profiling.

$$A=(B+C)/D \qquad \text{Formula 1}$$

B: the abundance ratio of silicon atoms each bonded to three oxygen atoms (calculated from the peak intensity at the bonding energy 102.52 eV of the Si2P orbital)

C: the abundance ratio of silicon atoms each bonded to four oxygen atoms (calculated from the peak intensity at the bonding energy 103.54 eV of the Si2P orbital)

D: the abundance ratio of silicon atoms each bonded to two oxygen atoms (calculated from the peak intensity at the bonding energy 101.79 eV of the Si2P orbital)

Moreover, the universal hardness was measured according to DIN50359 by means of a micro hardness tester Win-HUD, by gradually pressing an indenter against the fixing member under the conditions presented in Table 2 until a predetermined indentation depth, and determining the universal hardness from the pressing load and contact area of the indenter at the time when the indentation depth reached 5 μm.

Example 2

A fixing member was produced in the same manner as in Example 1, provided that instead of the fluoro silicone rubber, silicone rubber (DY35-2083, manufactured by Toray Industries, Inc.) was coated in the thickness of 200 μm, heated at 150° C. for 30 minutes, and subjected to secondary cure at 200° C. for 4 hours. The produced fixing member was evaluated in the same manner as in Example 1.

Example 3

A fixing member was produced in the same manner as in Example 1, provided that instead of OPTOOL DSX, tetraethoxysilane (i.e., tetraethyl orthosilicate) (manufactured by Wako Pure Chemical Industries, Ltd.) was applied by dip coating. The produced fixing member was evaluated in the same manner as in Example 1.

Example 4

A fixing member was produced in the same manner as in Example 2, provided that instead of OPTOOL DSX, tetraethoxysilane (i.e., tetraethyl orthosilicate) (manufactured by Wako Pure Chemical Industries, Ltd.) was applied by dip coating. The produced fixing member was evaluated in the same manner as in Example 1.

Example 5

A fixing member was produced in the same manner as in Example 1, provided that as the plasma reaction gas, nitrogen was used instead of argon. The produced fixing member was evaluated in the same manner as in Example 1.

Example 6

A fixing member was produced in the same manner as in Example 1, provided that as the plasma reaction gas, nitrogen was used instead of oxygen. The produced fixing member was evaluated in the same manner as in Example 1.

Example 7

A fixing member was produced in the same manner as in Example 1, provided that the resultant from the plasma treatment was used as a final product, i.e. the fixing member. The produced fixing member was evaluated in the same manner as in Example 1.

Example 8

A fixing member was produced in the same manner as in Example 1, provided that instead of OPTOOL DSX, tetraethyl orthsilicate (manufactured by Wako Pure Chemical Industries, Ltd.) was applied by dip coating, and acrylic rubber (Nipol AR51, manufactured by Zeon Corporation) was used instead of the fluorosilicone rubber. The produced fixing member was evaluated in the same manner as in Example 1.

Example 9

A fixing member was produced in the same manner as in Example 8, provided that the acrylic rubber was replaced with butyl rubber (BR51, manufactured by JSR Corporation). The produced fixing member was evaluated in the same manner as in Example 1.

Example 10

A fixing member was produced in the same manner as in Example 8, provided that the acrylic rubber was replaced with ethylene propylene rubber (EP11, manufactured by JSR Corporation). The produced fixing member was evaluated in the same manner as in Example 1.

Example 11

A fixing member was produced in the same manner as in Example 1, provided that instead of OPTOOL DSX, an ethanol solution of 50% titanium isopropoxide (manufactured by Japan Pure Chemical Co., Ltd.) was applied by dip coating. The produced fixing member was evaluated in the same manner as in Example 1.

Comparative Example 1

A primer layer for silicone was formed as a base on a cylindrical support (polyimide) having a length of 320 mm, and thickness of 50 μm, and was dried. Thereafter, fluorosilicone rubber (X36-420U, manufactured by Shin-Etsu Chemical Co., Ltd.) was formed in the thickness of 200 μm on the base, and heated at 150° C. for 10 minutes, to thereby prepare a fixing member. The produced fixing member was evaluated in the same manner as in Example 1.

Comparative Example 2

A fixing member was produced in the same manner as in Comparative Example 1, provided that instead of the fluorosilicone rubber, silicone rubber (DY35-2083, manufactured by Toray Industries, Inc.) was coated in the thickness of 200 μm, heated at 150° C. for 30 minutes, and subjected to secondary cure at 200° C. for 4 hours. The produced fixing member was evaluated in the same manner as in Example 1.

TABLE 1

| | |
|---|---|
| Device | Ulvac-PHI QuanteraSXM |
| Light source | Al (mono) |
| Output | 100 μm (diameter), 25.1 W |
| Measuring range | 500 μm × 300 μm |
| Pass energy | 55 eV (narrow scan) |
| Energy step | 0.1 eV (narrow scan) |
| Relative sensitivity coefficient | Using relative sensitivity coefficient of PHI |
| Sputtering source | C60 ionized cluster |
| Iron gun output | 10 kV, 10 nA |
| Raster Control | (X = 0.5, Y = 2.0) mm |
| Sputtering rate | 0.9 nm/min ($SiO_2$ conversion) |

TABLE 2

| | |
|---|---|
| Device | Win-HUD, manufactured by Fischer Instruments K.K. |
| Indenter | Quadrangular pyramid diamond having a plane angle of 136° |
| Initial load | 0.02 mN |
| Maximum load | 400 mN |
| Duration for increasing load | 10 sec |
| Indentation depth | 5 μm |
| Measuring temperature | 25° C. ± 2° C. |

TABLE 3

| Evaluation Item | Evaluation manner | Acceptable rank | Evaluation criteria |
|---|---|---|---|
| Peak of oxygen atom | Existence of the maximum value of | Present | Present or, Not present |

TABLE 3-continued

| Evaluation Item | Evaluation manner | Acceptable rank | Evaluation criteria |
|---|---|---|---|
| concentration | the oxygen atom concentration in the area that is 5 nm to 50 μm in depth from the outermost surface as detected by the XPS depth profiling specified in Table 1. | | |
| Peak sift | Existence of the sift of the peak at Si 2p orbital to the higher energy side, as measured by the XPS depth profiling specified in Table 1. | Present | Present or, Not present |
| Abrasion resistance | Evaluation by ranks of abnormal images formed due to scratches on the surface layer of the fixing member caused by friction abrasion with paper edges or abrasion by contact with a separation claw | 3 or higher (in number) | 1: Image fixing ability was significantly inhibited, and fixing failure was partially observed.<br>2: The resulting image was an abnormal image because there was a difference in glossiness in the image due to the traces of the abrasion<br>3: Acceptable level though there was a difference in glossiness in the image due to the traces of the abrasion (but not at the level regarded as an abnormal image)<br>4: No failure |
| Release properties | Evaluation of output images by ranks judged based on toner offset onto the surface of the fixing member and offset in the images | 3 or higher (in number) | 1: Toner offset on the fixing member, and offset in the image both occurred.<br>2: Toner offset on the fixing member, but offset occurred in the image, which was an abnormal image.<br>3: Toner offset on the fixing member, but offset occurred in the image (at the slight level that could be acceptable).<br>4: Both offset on the fixing member and in the image did not occur. |

TABLE 4

| | Oxygen atom concentration peak | Peak sift | Coeff-icient A | HU | Abrasion resistance | Release proper-ties |
|---|---|---|---|---|---|---|
| Ex. 1 | Present | Present | 0.5 | 0.32 | 4 | 4 |
| Ex. 2 | Present | Present | 0.8 | 0.36 | 4 | 3 |
| Ex. 3 | Present | Present | 0.88 | 0.34 | 4 | 3 |
| Ex. 4 | Present | Present | 0.8 | 0.38 | 4 | 3 |
| Ex. 5 | Present | Present | 0.6 | 0.4 | 3 | 3 |
| Ex. 6 | Present | Present | 0.8 | 0.45 | 3 | 3 |
| Ex. 7 | Present | Present | 0.6 | 0.32 | 3 | 3 |
| Ex. 8 | Present | Present | 0.9 | 0.5 | 4 | 3 |
| Ex. 9 | Present | Present | 1.4 | 0.44 | 4 | 3 |
| Ex. 10 | Present | Present | 1.2 | 0.43 | 4 | 3 |
| Ex. 11 | Present | Present | 1 | 0.3 | 4 | 3 |

TABLE 4-continued

| | Oxygen atom concentration peak | Peak sift | Coeff-icient A | HU | Abrasion resistance | Release proper-ties |
|---|---|---|---|---|---|---|
| Comp. Ex. 1 | Not present | Not present | 0.2 | 0.22 | 1 | 2 |
| Comp. Ex. 2 | Not present | Not present | 0.34 | 0.31 | 1 | 1 |

Note that, in Table 4, "HU" denotes universal hardness.

The following points were found based on the results above.

In Comparative Example 1, the abrasion of the surface of the fixing member was significantly progressed, which caused fixing failure. Although the offset onto the member did not occur in the evaluation for release properties, image offset occurred to such extent that the resulted image was regarded as an abnormal image, which was not at an acceptable level.

In Comparative Example 2, the abrasion of the surface of the fixing member was significantly progressed, which caused fixing failure. In terms of the evaluation for the release properties, both the offset onto the fixing member and the offset in the image that was an equivalent to an abnormal image occurred. Accordingly, it did not reach to the acceptable level.

In comparison to Comparative Examples 1 and 2, the fixing member of Example 1 reached the highest acceptable levels in the ranks in all of the evaluation items of the abrasion resistance, and the release properties, and the effect of the invention could be confirmed.

In Examples 2, 3, 4, 8, 9, 10, and 11, the fixing members thereof reached the acceptable levels, though the release effect was lower than the level achieved by Example 1, and the effect of the invention could be confirmed. In Examples 5, 6, and 7, the fixing members thereof reached the acceptable levels, though the abrasion resistance and the release properties were lower than the levels achieved by Example 1, and the effect of the invention could be confirmed.

As has been mentioned above, the present invention can provide a fixing member, which has excellent abrasion resistance, and does not cause image failures due to abrasion over a long period, when it is used in an image forming apparatus. Moreover, the present invention can provide a fixing member having sufficiently preferable release properties for not causing image offset. As a result, a fixing device the duration and reliability of which has been improved can be provided. Because of this fixing device, an electrophotographic photocopier, facsimile, or laser printer having high durability and reliability can be achieved, and be used, which contributes to "reduction in environmental loads" or "improvement in customer satisfaction."

INDUSTRIAL APPLICABILITY

The fixing member of the present invention can achieve both high image quality and high reliability, and can achieve stable fixing over a long period, and thus is suitably used as a so fixing member for electrophotographic photocopiers, facsimiles, and laser printers.

REFERENCE SIGNS LIST

101 photoconductor drum
102 charging roller
103 laser beam (exposure light)

104 developing roller
105 power pack
106 transfer roller
107 recording sheet
108 cleaning device
109 surface electrometer
110 heat fixing roller
111 pressure roller
112 belt fixing device
113 fixing belt
111 fixing roller
115 pressure roller
116 heat roller
201 base
202 elastic layer

The invention claimed is:

1. A fixing member, comprising:
a base; and
a polyorganosiloxane layer provided on the base, where the polyorganosiloxane layer is a surface layer and contains polyorganosiloxane including a silicon atom bonded to three or four oxygen atoms,
wherein the fixing member is designed to be used in a process for heating a toner image on a recording medium to fix the toner image onto the recording medium, and
wherein a thickness of the polyorganosiloxane layer is 0.01 μm to 5 μm.

2. The fixing member according to claim 1, wherein the fixing member has the maximum value of an oxygen atom concentration in an area, which is 5 nm to 50 μm in depth from an outermost surface of the fixing member.

3. The fixing member according to claim 1, wherein the fixing member has the minimum value of a carbon atom concentration in an area which is 5 nm to 50 μm in depth from an outermost surface of the fixing member.

4. The fixing member according to claim 1, wherein a depth of the fixing member where an oxygen atom concentration has the maximum value and a depth of the fixing member where a carbon atom concentration has the minimum value are identical.

5. The fixing member according to claim 1, wherein the polyorganosiloxane layer has a surface to which a perfluoroalkyl ether group is bonded via an oxygen atom.

6. The fixing member according to claim 1, further comprising an elastic layer provided between the base and the polyorganosiloxane layer.

7. The fixing member according to claim 6, wherein the elastic layer contains elastic rubber having siloxane bonds in a principle chain thereof.

8. The fixing member according to claim 7, wherein the elastic rubber is fluorosilicone rubber.

9. The fixing member according to claim 1, wherein the fixing member has a universal hardness of 0.5 $N/mm^2$ or lower with an indentation depth of 5 μm.

10. A fixing device, comprising:
a fixing member,
wherein the fixing member comprises:
a base; and
a polyorganosiloxane layer provided on the base, where the polyorganosiloxane layer is a surface layer and contains polyorganosiloxane including a silicon atom bonded to three or four oxygen atoms,
wherein the fixing member is designed to be used in a process for heating a toner image on a recording medium to fix the toner image onto the recording medium, and
wherein a thickness of the polyorganosiloxane layer is 0.01 μm to 5 μm.

11. The fixing device according to claim 10, wherein the fixing device contains a fixing roller and a pressure roller provided to face the fixing roller, where at least either of the fixing roller or the pressure roller is the fixing member.

12. The fixing device according to claim 10, wherein the fixing device contains a fixing belt, where the fixing belt is the fixing member.

13. An image forming apparatus, comprising:
a fixing device which comprises a fixing member,
wherein the fixing member comprises:
a base; and
a polyorganosiloxane layer provided on the base, where the polyorganosiloxane layer is a surface layer and contains polyorganosiloxane including a silicon atom bonded to three or four oxygen atoms,
wherein the fixing member is designed to be used in a process for heating a toner image on a recording medium to fix the toner image onto the recording medium, and
wherein a thickness of the polyorganosiloxane layer is 0.01 μm to 5 μm.

* * * * *